United States Patent [19]

Lamy

[11] 4,372,752

[45] Feb. 8, 1983

[54] FUEL FOR PISTON INTERNAL COMBUSTION INJECTION ENGINES

[76] Inventor: Jacques E. Lamy, 16, rue d'Estienne d'Orves, 92260 Fontenay-Aux-Roses, France

[21] Appl. No.: 22,562

[22] PCT Filed: Jun. 30, 1978

[86] PCT No.: PCT/FR78/00006

§ 371 Date: Mar. 7, 1979

§ 102(e) Date: Mar. 6, 1979

[87] PCT Pub. No.: WO79/00029

PCT Pub. Date: Jan. 25, 1979

[51] Int. Cl.[3] ..... C10L 1/00

[52] U.S. Cl. ..... 44/50; 44/52; 44/57

[58] Field of Search ..... 44/57, 50, 52

[56] References Cited

U.S. PATENT DOCUMENTS 2,866,693 12/1958 Allen ..... 44/52

OTHER PUBLICATIONS

"Petroleum Products Handbook", Guthrie, 1st Ed., 1960, pp. 12–24 and 12–25.

*Primary Examiner*—Charles F. Warren
*Assistant Examiner*—Y. Harris-Smith
*Attorney, Agent, or Firm*—Stevens, Davis, Miller & Mosher

[57] ABSTRACT

There is disclosed a fuel for use in an internal combustion compression engine having the following features:

(a) in the standard ASTM distillation test, distillation commences at about 30° C. to terminate in the same range of temperature as conventional gas-oils for high-speed engines;

(b) in this same standard ASTM distillation test about 90% of the volume passes into the graduated collector at a temperature lying between about 210° to 250° C. and 360° C.

5 Claims, 1 Drawing Figure

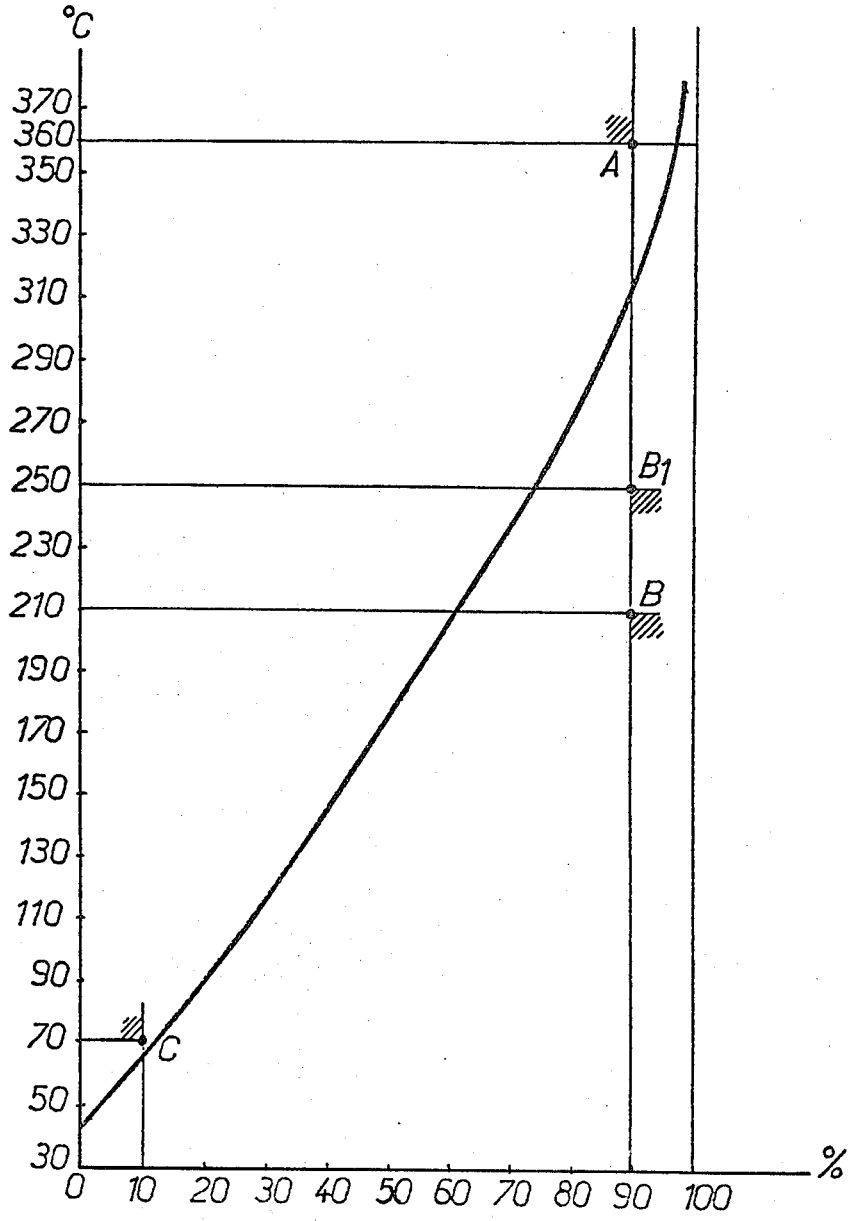
°C
370
360
350
330
310
290
270
250
230
210
190
170
150
130
110
90
70
50
30
0
10
20
30
40
50
60
70
80
90
100
%
A
B1
B
C

FUEL FOR PISTON INTERNAL COMBUSTION INJECTION ENGINES

BACKGROUND OF THE INVENTION

It is known that by distillation crude petroleum can be fractionated into a number of varied products which are distinguished from one another especially by their volatility.

In the feeding of spark ignition internal combustion engines the so-called petrol or gasoline fraction is used, which, as a result of its volatility, enables carburetting of the air to be effected before its introduction into the engine cylinders.

The Diesel cycle has enabled heavier fractions to be employed, such as gas-oil which is injected separately into the engine cylinders at the end of the phase of compression of the air and which ignites spontaneously due to the heat of compression.

Hitherto one has lived with this binary system of piston engine fuels and the corresponding two classes of engines.

For engines having carburettors where the air loaded with fuel is compressed in the cylinders before ignition it is advisable for the fuel to have anti-knock properties which have come to be characterized by the octane number.

The natural distillate from petroleum generally has a poor octant number which permits only an equally poor degree of compression. In order to improve the performance of carburettor engines one is compelled to increase this octane number by various artifices. One of them is the addition to the gasoline of products such as tetra-ethyl lead which unfortunately is very poisonous and hence presents a serious disadvantage in relation to pollution. In addition it contributes to the fouling of engines by deposits of lead and to corrosion of the valves.

Another artifice currently applied in petroleum refineries consists in taking fractions of the distillate which are respectively heavier and lighter than gasoline and in converting them by cracking or reforming operations in order to obtain hydrocarbons of aromatic or naphthene type having anti-knock properties, which are mixed with the gasoline fraction in order to increase its octane number.

But this procedure, apart from the fact that it necessitates complicated and costly apparatus, introduces losses resulting from the fuel that is burned for heating the apparatus and gives as residue gases which are generally burned in a flare. These losses may be evaluated at about 5% of the crude petroleum.

It is obvious that in the present economic situation these losses constitute a serious disadvantage.

On the other hand Diesel engines have made considerable technical progress and today for the propulsion of motor vehicles even in towns high-speed Diesel engines can be produced, having low weight, a certain flexibility in running and being not very noisy.

GENERAL DISCUSSION OF THE INVENTION

The applicant has had the idea of replacing the two types of fuel by a single fuel called "long-cut" incorporating light and heavy fractions from crude petroleum, which is well suited to operation of modern Diesels and particularly ante-chamber Diesels so that this new fuel for piston engines should progressively replace the two present fuels at the same time that the Diesel engine would replace the prior carburation engine, thus eliminating the above-mentioned shortcomings since in particular for the Diesel engine there is no need of a high octane number.

As the Diesel engine has generally specific consumptions lower than the gasoline engine, two sources of economy are cumulated: one during the course of refining and the other in the operation of the engine. As the Diesel engine also allows easier fitting of an exhaust turbo-compressor, progress along the path of economy might be made general thanks to a more versatile fuel than gas-oil.

Since this new fuel will take over part of the market for gasoline in addition to that for gas-oil it must be widely available from crude petroleum.

It will consist in its widest definition of the whole of the distillation fractions comprising gas-oil for high speed engines and lighter fractions the designation of which varies but which conventionally comprises the kerosenes and the distillates sometimes called heavy and light naphthas. Hence it will comprise conventional gas-oil and the distillation cuts which distill at temperatures lower than those of the gas-oil cut.

The new long-cut fuel which will be designated below by LC for convenience of speech and which forms the object of the invention, is characterized mainly by the following features:

(a) in the standard ASTM distillation test, distillation commences at about 30° C. to terminate in the same range of temperature as that of conventional gas-oils for high-speed engines;

(b) in this same standard distillation test about 90% of the volume passes into the graduated collector at a temperature ranging between about 210° to 250° C. and 360° C.

Such a fuel which represents about 50 to 60% by volume of the crude petroleum instead of 10 to 20%, as is the case for light gas-oil for motor vehicles, presents not only the advantages which have been indicated but again, thanks to the presence of products heavier than gasoline, has a lubricating power sufficient for the proper operation of pumps, injectors and accessories, whilst containing volatile products which facilitate cold starting of Diesel engines.

It goes without saying that this fuel is more available in crude petroleum than the present gasoline for motor vehicles since the latter especially because of the octane number requirements, calls for specific elaborations and is not as a rule available by mere distillation from the crude.

It is furthermore necessary to prevent the fuel from falling within the range of ground-level explosivity which is characterized by the presence of volatile hydrocarbons in an amount sufficient for the saturated atmosphere which lies above the liquid fuel in a tank to overreach the zone of inflammability, current temperature in geographical locations of normal use.

Thus it is known that in a tank containing liquid gasoline, even only in a small amount, the atmosphere is generally too vapor rich to ignite, at least in temperate climates, that is to say, those where the winter temperature is higher than −20° C.

In contrast, in the case of kerosene and a fortiori gas-oil, the saturated atmosphere is too vapor-poor to ignite.

But if one is dealing with mixtures of kerosine and gasoline the saturated atmosphere in tanks may arrive at conditions for ignition, hence for deflagration and for explosion.

In order not to complicate excessively the commercial distribution of the fuel in accordance with the invention it is advisable to make it comparable with gasoline in the above standpoint.

To this end the fuel should contain a minimum of light hydrocarbons, this minimum being characterized by a minimum of Reid vapor pressure or a minimum of the percentage distilling at low temperatures in the standard distillation test.

This proportion of light hydrocarbons corresponds with a Reid vapor pressure higher than 50 piezes or 500 g/cm$^2$ or possibly only higher than 35 to 40 piezes depending upon the local conditions of use.

As far as the minimum percentage distilling at low temperatures is concerned the composition may be adapted so that 10% of the volume distils below 70° or 75° C., this limit depending upon the minimum atmospheric temperature in the geographical territory of use.

From another point of view it is known that in order to avoid vapor locks in the feed circuit to an engine and depriming of the feed pump, it is advantageous for the Reid vapor pressure not to exceed a certain value, for example, in France and other temperate countries, 65 piezes in summer and 80 piezes in winter.

The attached drawing shows by way of example the standard distillation curve of a long-cut fuel in accordance with the invention. Temperatures in degrees centigrade are plotted as ordinates and the percentages of product collected in the graduated vessel are plotted as abscissae.

The point A represents the upper limit of temperatures (360° C.) corresponding with the condition b above, whilst the points B and $B_1$ correspond with the range of lower limit (210°–250° C.). The point C corresponds with the presence of a minimum of volatile hydrocarbons according to what has been said above (10% distillate below 70°–75° C.).

Such a curve enables one skilled in the art, that is to say, specialists in the refining of petroleum, to produce a fuel in accordance with the invention, starting with a crude, whatever its origin.

Thus it is possible to start, in conventional manner, by fractionating the crude, for example, in a plate distillation column, then to recombine suitable proportions of the fractions thus separated in order to constitute the LC fuel in accordance with the invention. The specialist in distillation will have no difficulty in determining the suitable proportions of the various fractions. If the occasion arises, gaseous hydrocarbons such as butane or pentanes may be dissolved in the mixture.

The production yield by direct distillation of the new fuel results from the following tables in which the percentages of gas-oil and of the new LC fuel have been given, which may be obtained with crudes of different origins. Gasoline for motor vehicles are not set forth because it requires reprocessing of certain fractions and its availability depends both on the nature of the crude and the refining equipment available.

Amongst the problems posed by the refining of available crude petroleums, it may be necessary to thermally break down (for example, by catalytic cracking) fractions of petroleums stocks heavier than gas-oils in order to avoid having too much of the heavy fractions. In fact the market for these fractions might tend to diminish because of the part taken by the increasing employment of atomic or even coal power stations and the use of their residual heat. In these circumstances the refiners would be led to employ catalytic crackers for heavy products which can be adapted for the production either of gasoline of high octane number or of products in the range known as gas-oils. Adoption of the LC fuel will make these adaptations more flexible by permitting the use of products of any nature. The use and the operation of catalytic crackers, whether hydrogenating or not, may be simplified by it and corresponding investments reduced.

| Crude | Arabian Heavy | Arabian Medium | Arabian Light | Iran Light | Iran Sassan |
|---|---|---|---|---|---|
| % gas-oil | 16% | 18 | 20 | 14 | 20 |
| % LC | 43% | 50 | 60 | 55 | 55 |

| Algeria | Messaoud | Kuwait | | Irak | Qatar | Zakum |
|---|---|---|---|---|---|---|
| % gas-oil | 23 | 14 | 10 | 18 | 20 | 19 |
| % LC | 70 | 42 | 50 | 50 | 70 | 63 |

It is known that the combustion of gas-oils in Diesel engines leads to the use of minimum cetane index in order to avoid knocking in these engines. This results from a property which is the reverse of non explosiveness of gasoline for controlled ignition engines. There will be no reason to change it in the development of the use of LC.

It is possible in order to expedite refining, to specify a maximum content of aromatic hydrocarbons, for example, 20 or 25%, in order to obtain a product giving less knocking and a minimum of smoke in the exhaust.

The maximum temperature point A (360°) for the 90% point on the distillation curve corresponds also to the purpose of not offering to combustion too heavy hydrocarbons which would cause deposits and smoke. The temperature of 360° C. corresponds to a slight increase in gravity in comparison with conventional gas-oils. It might be raised by the use of light fractions in the "long-cut" fuels.

The requirements regarding sulphur content will be preserved as for conventional gas-oils intended for use in motor vehicles. They will generally be more easy to meet for refining because the natural sulphur content often increases with the density of the distillation cuts. It follows that it is possible to minimize the maximum sulphur content of the "long-cut" fuel relative to that of conventional gas-oils.

I claim:

1. A fuel designed for injection into a reciprocating internal combustion engine, said fuel consisting essentially of a stock containing light and heavy hydrocarbons present in crude oil and having the following properties:

(a) the light-hydrocarbon content is such that 10% of the volume distills at a temperature lower than about 70°–75° C., and the Reid vapor pressure is higher than 35 piezes;

(b) about 90% of the volume is collected at a temperature ranging between about 210° C. and 360° C.; and (c) the final distillation is in the same temperature range as conventional gas-oil for current automotive engines.

2. The fuel of claim 1, wherein said light-hydrocarbon content is such that the Reid vapor pressure is higher than 50 piezes.

3. The fuel of claim 1, wherein said light-hydrocarbon content is such that the Reid vapor pressure is less than about 80 piezes.

4. The fuel of claim 1, wherein the maximum aromatic hydrocarbon content is of the order of 20–25%.

5. The fuel of claim 1 wherein about 90% of the volume is collected at a temperature ranging between about 250° C. and 360° C.

* * * * *